United States Patent [19]

Lipschitz

[11] 4,339,853

[45] Jul. 20, 1982

[54] MAGNETIC DECOUPLER

[75] Inventor: Henry Lipschitz, Atlantic Beach, N.Y.

[73] Assignee: Permag Corporation, Hicksville, N.Y.

[21] Appl. No.: 127,188

[22] Filed: Mar. 4, 1980

[51] Int. Cl.[3] ..... H01F 3/12

[52] U.S. Cl. ..... 24/155 BR; 24/136 R; 24/201 B; 292/252; 335/236; 335/295

[58] Field of Search ..... 24/155 BR, 136 R, 136 A, 24/263 SW, 150 R, 201 B, 104, 90 HA; 292/252; 335/236, 286, 293, 295; 248/206 A; 403/DIG. 1

[56] References Cited

U.S. PATENT DOCUMENTS

| | | | |
|---|---|---|---|
| 2,269,149 | 1/1942 | Edgar | 24/201 B |
| 3,164,756 | 1/1965 | Steingroever | 335/295 |
| 3,858,280 | 1/1975 | Martens | 24/155 BR |
| 3,911,534 | 10/1975 | Martens et al. | 24/150 R |
| 3,947,930 | 4/1976 | Martens et al. | 24/155 BR |
| 3,974,581 | 8/1976 | Martens et al. | 24/155 BR |
| 4,000,543 | 1/1977 | Paskert | 24/150 R |
| 4,012,813 | 3/1977 | Martens et al. | 24/150 R |
| 4,104,622 | 8/1978 | Van Niel | 24/150 R |
| 4,156,302 | 5/1979 | Van Niel | 24/150 R |
| 4,265,002 | 5/1981 | Hosken | 24/201 B |

FOREIGN PATENT DOCUMENTS

| | | | |
|---|---|---|---|
| 1616054 | 1/1971 | Fed. Rep. of Germany | 335/236 |
| 304634 | 7/1971 | U.S.S.R. | 335/236 |
| 675231 | 8/1979 | U.S.S.R. | 24/136 R |

*Primary Examiner*—Victor N. Sakran

*Attorney, Agent, or Firm*—Ostrolenk, Faber, Gerb & Soffen

[57] ABSTRACT

A magnetic decoupler for use with an antitheft device is disclosed. In one preferred embodiment, the decoupler includes a composite permanent magnet comprising an annular permanent magnet that may be of ceramic and a second, preferably disc-shaped permanent magnet, which is preferably more strongly magnetized than the annular magnet and which preferably comprises a rare earth element. The two magnets are coaxially aligned with but axially displaced from each other and are oriented with the opposite polarity so as to create a region of especially great magnetic flux in the bore of the annular magnet. A cover plate, preferably of cold-rolled steel, may be provided adjacent the face of the annular magnet that is remote from the second magnet to further concentrate the flux in the bore.

9 Claims, 4 Drawing Figures

MAGNETIC DECOUPLER

BACKGROUND OF THE INVENTION

This invention pertains generally to magnets and more particularly pertains to magnetic decouplers for use with antitheft devices.

A known antitheft device for use in stores selling such goods as clothing or dry goods comprises a disc that sets off an alarm if taken out of the store. One typical disc of this type is manufactured by the Knogo Corp., of Hicksville, New York, and sold under the trade name THE KNOGO WAFER. The disc is attached to the goods to be protected by means of a tapered pin inserted through the goods and into one side of the disc. The length of the pin is greater than the thickness of the disc, and the side of the disc opposite that into which the pin is inserted is provided at its center with a nipple in which the pin is accommodated, so that the full length of the pin can be inserted into the disc. The pin has at least one circumferential groove. The nipple contains a mechanism for engaging the groove in the pin, which mechanism is constructed so that the pin can be easily inserted into it but, once inserted, cannot be withdrawn until the gripping mechanism can be made to disengage the groove. As a result, a potential thief cannot remove the disc from an article of merchandise. A special magnetic decoupler used to permit the removal of the disc by the clerk when the article is purchased. The magnetic decoupler includes a cavity into which the nipple is inserted, and a permanent magnet of suitable design provides a magnetic field in the cavity with a flux in such a direction within the cavity as to force the gripping mechanism in the nipple to disengage from the groove, allowing removal of the pin from the disc.

SUMMARY OF THE INVENTION

The chief object of the present invention is to provide an inexpensive, strong and compact magnetic decoupler for use with an antitheft device of the type described above.

According to the present invention, a relatively inexpensive, but nonetheless powerful, composite permanent magnet is provided. One part of this magnet is an annular permanent magnet made of a relatively inexpensive material such as ceramic and having a bore large enough to accommodate the nipple of the disc. The composite magnet also comprises a disc shaped, more powerful permanent magnet whose diameter is approximately equal to that of the bore of the annular magnet. The two magnets are aligned coaxially with but axially displaced from each other. The poles of the two magnets are oriented in opposite directions so that flux lines proceed from the face of the annular magnet remote from the disc magnet through the bore of the annular magnet to the near face of the disc magnet.

A plate of cold-rolled steel or other suitable magnetic material is placed on the face of the annular magnet remote from the disc magnet to further concentrate and focus the lines of magnetic flux in the bore of the annular magnet. The face plate is provided with a hole aligned with the bore of the annular magnet.

When the antitheft device is to be unlocked, the nipple is placed in the cavity defined by the bore of the annular magnet, and the strong magnetic field therein causes the gripping mechanism of the disc to disengage from the groove of the pin.

BRIEF DESCRIPTION OF THE FIGURES

For the purpose of illustrating the invention, there is shown in the drawings an embodiment which is presently preferred; it is to be understood, however, that the invention is not limited to the precise arrangements and instrumentalities shown.

DETAILED DESCRIPTION OF THE INVENTION

Figure 1:
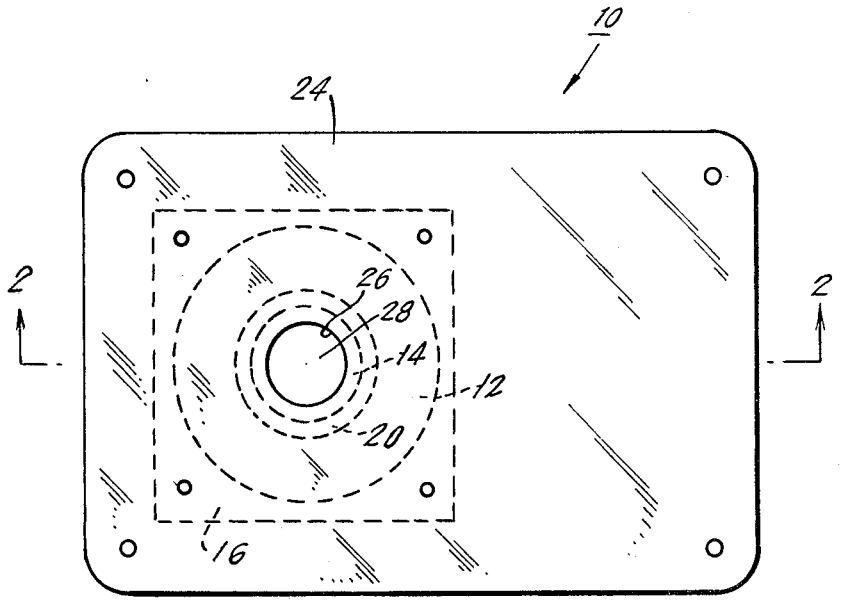
FIG. 1 is a top view of the preferred embodiment of the magnetic decoupler of the invention.
Figure 2:
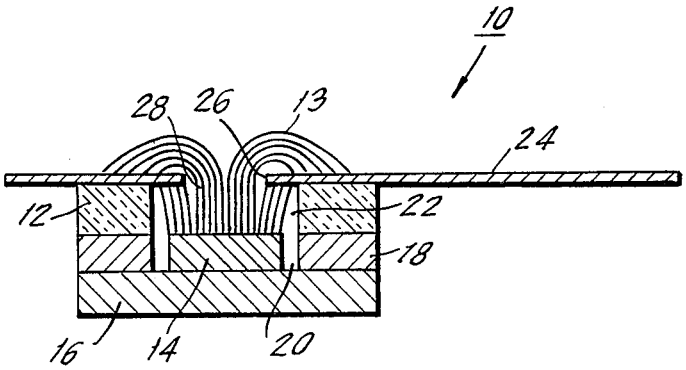
FIG. 2 is a sectional view of the preferred embodiment taken along section line 2—2 of FIG. 1.

As shown in FIGS. 1 and 2, the magnetic decoupler 10 of the invention includes a composite permanent magnet comprising two separate permanent magnets 12 and 14. High coercive force permanent magnet 14 is disc-shaped and is disposed on steel plate 16. The magnet 14 is surrounded by a second annular steel plate 18 that is at least as thick as disc-shaped magnet 14 and that is disposed on the first steel plate 16. The other, low coercive force permanent magnet 12 is annular and is disposed on the annular steel plate 18, the bores 20 and 22 of annuli 18 and 12, respectively, being aligned. The upper and lower faces of the disc magnet 14 are its pole faces, as are the upper and lower faces of the annular magnet 12. The two magnets 12 and 14 are oriented so that the upper surface of disc magnet 14 and the lower surface of annular magnet 12 have the same polarity. As a result of this arrangement, flux lines having one end at the upper surface of disc magnet 14 pass through the bore of the annular magnet 12 and have their other end at the upper surface of magnet 12. A cover plate 24 of cold-rolled steel is provided to carry the flux off the annular magnet 12 for the purpose of concentrating and focusing the flux lines in the bore 22 still further. The cover plate 24 is provided with a hole 26 aligned with bore 22 and large enough to accommodate the nipple of the antitheft device with which the magnetic decoupler is to be used. The cover plate 24, the bore 22 of the annular magnet 12 and the upper face of the disc-shaped magnet 14 define a cavity 28 into which the nipple is inserted for unlocking.

According to the preferred embodiment of the invention, the disc-shaped magnet 14 is a relatively strong magnet and is made of a composition including a rare earth element, for example, SmCo. With the novel configuration of the magnetic decoupler, the annular permanent magnet 12 need not be very strong and may be made of a magnetic ceramic material such as oriented barium ferrite or strontium ferrite.

As is explained below, the gripping mechanism of the antitheft wafer 36 can be unlocked only by being subjected to a strong force acting downward (in the orientation of FIGS. 3 and 4). A force component acting perpendicularly to this direction not only is useless but appears to hinder the unlocking of the gripping mechanism 34. When the nipple 38 of the wafer 36 is inserted in the cavity 28, therefore, a magnetic flux with as strong a vertical component (in the orientation of FIG. 2), and as weak a horizontal component, as possible must be provided.

The flux lines 13 of the annular magnet 12 passing from the upper to the lower face of magnet 12 via the bore 22 can be thought of as squeezing the flux lines of the disc shaped magnet 12 in toward the center of the bore 22. The magnetic flux in the bore 22 due to the composite magnet, as a result, is extremely strong and is almost completely vertical.

It has been found that the composite magnet of the invention is substantially more effective for use in unlocking an antitheft disc of the type described hereinbelow as a magnet consisting of three SmCo magnets indentical to the disc shaped magnet 14, arranged coaxially and back-to-back. Since such a SmCo magnet is typically many times as expensive as a ceramic magnet like magnet 12, the invention is a relatively inexpensive decoupler.

The cover plate 24 is preferably made of a ferromagnetic material (e.g. cold rolled steel) but may be made of a non-ferromagnetic material such as aluminum. Tests have shown that the use of a ferromagnetic plate 24 focuses the magnetic flux in cavity 28 unexpectedly more effectively than a non-ferromagnetic plate and more effectively than would have been predicted for a ferromagnetic plate. Comparative tests were performed to determine the vertical pull of the decoupler of the present invention on a ferromagnetic core that simulates the core 52 of the gripping mechanism 34. In such tests the decoupler of the present invention with a non-ferromagnetic cover plate developed a force of 450–475 grams, while the decoupler with a cold rolled steel cover plate exerted a force of 550–575 grams on the core.

The cover plate 24, annular magnet 12 and steel plates 18 and 16 are held together in the preferred embodiment by screws 30 located at the corners of steel plate 16. Screw holes 32 are also provided at the corners of cover plate 24 to permit the magnetic decoupler to be securely fastened to a store counter.

The magnetic decoupler of the invention is compact, structurally strong and relatively inexpensive, and provides a narrow, intense and permanent magnetic field.

In order to understand fully the operation of the decoupler of the invention, it is necessary first to understand the functioning of the gripping mechanism of the antitheft disc. This will be described in the following.

Figure 3:
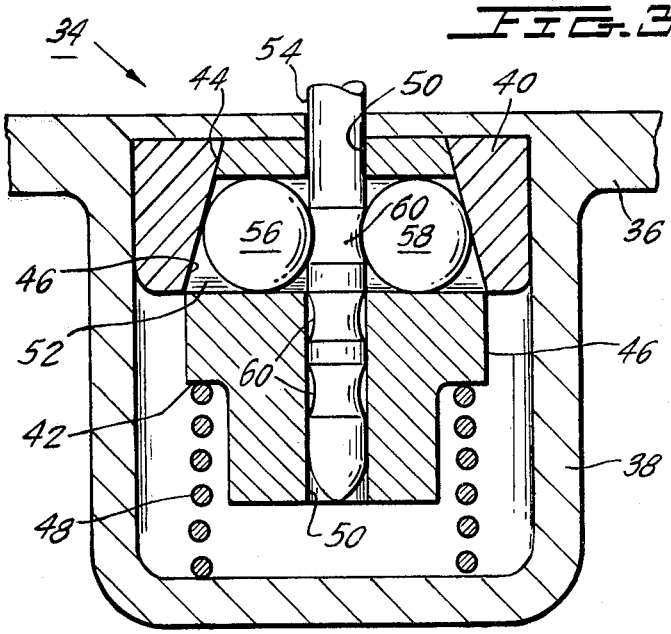
FIG. 3 is a sectional view of the gripping mechanism of the antitheft disc engaging the tapered pin.
Figure 4:
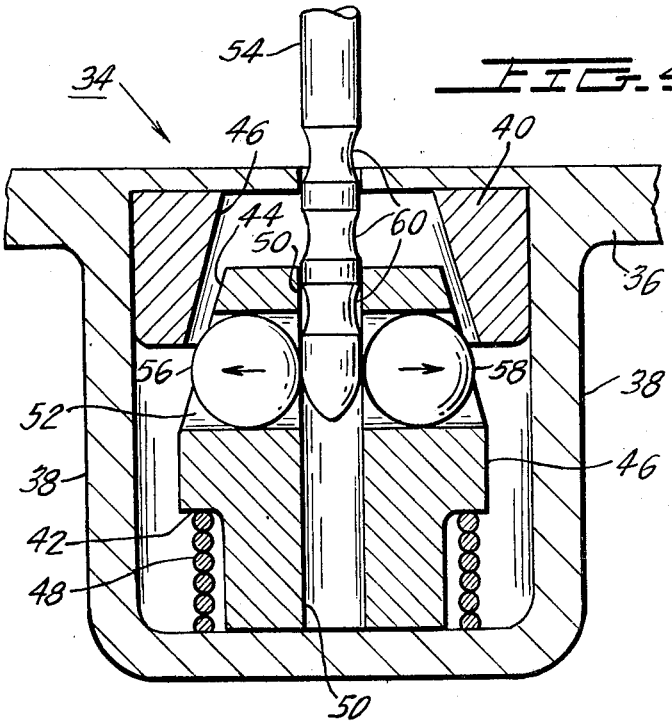
FIG. 4 is a view similar to FIG. 3, in which the nipple of the antitheft disc is inserted in the bore of the decoupler of FIGS. 1 and 2, allowing the pin to be removed from the disc.

FIGS. 3 and 4 show the gripping mechanism 34 of the antitheft device 36. Mechanism 34 is located in nipple 38 of disc 36 and includes both a collar 40 and a core 42. Collar 40 is secured to the interior of the base portion of nipple 38 and has a conical inner surface 44. Core 42 is located within nipple 38 and has an outer conical surface 46 which is urged upward into contact with the inner conical surface 44 of collar 40 by spring 48.

A vertical bore 50 is formed in core 42 and receives the shaft of tapered pin 54 when pin 54 is inserted into nipple 38. A horizontal bore 52 is also formed in core 42 and intersects the vertical bore 50. Two ball bearings 56, 58 are located in bore 52. When the outer surface 46 of core 42 engages the interior surface 44 of collar 40, surface 44 blocks the open ends of bore 52 causing bearings 56, 58 to be wholly contained within bore 52. The size of ball bearings 56, 58 is sufficiently large to extend into vertical bore 50 and to engage grooves 60 of pin 54 when the pin is located in nipple 38.

Before pin 54 is inserted into nipple 38, core 42 is in the position illustrated in FIG. 3 and ball bearings 56, 58 extend into bore 50. When pin 54 is first inserted into nipple 38, its tapered front end contact balls 56, 58 and urges core 42 downward against the force of spring 48. As core 42 moves downward, ball bearings 56, 58 are permitted to slide radially outward from the shaft of pin 54 due to the conical shape of the interior surface of collar 40. Core 42 continues moving downward until the distance between ball bearings 56, 58 is equal to the diameter of the shaft of pin 54. At this time, pin 54 is free to move into nipple 38. As a result of the foregoing, pin 54 is free to slide into nipple 38 at the users discretion.

Once pin 54 has been placed in nipple 38, it cannot be removed therefrom without the use of a decoupler such as decoupler 10 of the present invention. If any attempt is made to remove pin 54 from nipple 38, the shaft of pin 54 moves slightly upward until ball bearings 56, 58 engage anyone of the grooves 60 formed in pin 54. Once this has occurred, the ball bearings 56, 58 are forced into groove 60 by the inner conical surface of collar 40 and prevent the further removal of pin 54. Accordingly, pin 54, and along with it disc 36, cannot be removed from the article of clothing by a potential thief.

In order to unlock the disc 36 and permit the removal of pin 54, nipple 38 is inserted into cavity 28 of decoupler 10. The strong, highly focused, mostly vertical magnetic field in cavity 28 pulls core 42 downward against the force of spring 48 until the open ends of bore 52 are no longer blocked by collar 40. See FIG. 4. As a result, the ball bearings 56 are free to move outward from vertical bore 50, in response to an upward tug on pin 54, allowing the pin 54 to be easily removed from the disc 36.

Although a preferred embodiment of the invention has been described in detail, many modifications and variations thereof will now be apparent to one skilled in the art. Accordingly, the scope of the present invention is to be limited not by the details of the preferred embodiment herein described, but only by the terms of the appended claims.

What is claimed is:

1. A composite magnet, comprising:

an annular, ceramic magnet having opposed substantially flat faces and a bore extending between said faces along a first axis, a first of said flat faces defining a first pole of said ceramic magnet having a first polarity, a second of said flat faces defining a second pole of said ceramic magnet having a second, opposite, polarity;

a cylindrical rare earth magnet having opposite substantially flat faces and a central axis coaxial with said first axis, a first of said flat faces of said rare earth magnet defining a first pole of said rare earth magnet having said first polarity, the second of said flat faces of said rare earth magnet defining a second pole of said rare earth magnet having said second polarity; and means for orienting said magnets relative to one another such that said ceramic magnet serves to both focus and add to the flux lines of said rare earth magnet and such that said flux lines extend between said first flat face of said rare earth magnet and said second flat face of said ceramic magnet along a path which passes through said bore of said ceramic magnet in a direction substantially parallel to said first axis whereby a strong magnetic field is defined in said bore.

2. The composite magnet of claim 1, wherein said orienting means includes a cover plate having a face adjacent said second face of said ceramic magnet.

3. The composite magnet of claim 2, wherein said cover plate is formed of cold-rolled steel.

4. The composite magnet of claim 1, wherein said rare earth magnet is formed of SmCo.

5. The composite magnet of claim 1, wherein said first flat face of said rare earth magnet and said first flat face of said ceramic magnet lie substantially in a common plane.

6. The composite magnet of claim 2, wherein said orienting means further includes a first base plate on which said rare earth magnet is disposed and means for coupling said first base plate to said cover plate.

7. The composite magnet of claim 6, further comprising a second base plate, said second base plate being annular and being disposed on said first base plate and surrounding said rare earth magnet.

8. The composite magnet of claim 7, wherein said ceramic magnet is disposed on said second base plate.

9. In combination, a composite magnet according to any one of claims 2–8 or 1 and an antitheft device comprising:

a pin having a tapered shaft provided with at least one circumferential groove;

a main body having a nipple and having a first bore in said main body and extending into the interior of said nipple, and said nipple being small enough to be received in said bore of said annular magnet; and gripping means housed in the interior of said nipple for securely engaging said groove in said shaft of said pin when said pin is inserted in said first bore, it being possible to disengage said gripping means from said groove only by inserting said nipple in said bore of said annular magnet.

* * * * *